US010923053B2

(12) United States Patent
Chen

(10) Patent No.: US 10,923,053 B2
(45) Date of Patent: Feb. 16, 2021

(54) LIQUID CRYSTAL DISPLAY DEVICE

(71) Applicants: HKC CORPORATION LIMITED, Guangdong (CN); CHONGQING HKC OPTOELECTRONICS TECHNOLOGY CO., LTD., Chongqing (CN)

(72) Inventor: Yu-Jen Chen, Chongqing (CN)

(73) Assignees: HKC CORPORATION LIMITED, Guangdong (CN); CHONGQING HKC OPTOELECTRONICS CO., LTD., Chongqing (CN)

( * ) Notice: Subject to any disclaimer, the term of this patent is extended or adjusted under 35 U.S.C. 154(b) by 0 days.

(21) Appl. No.: 16/471,714

(22) PCT Filed: Dec. 16, 2017

(86) PCT No.: PCT/CN2017/116708
§ 371 (c)(1),
(2) Date: Jun. 20, 2019

(87) PCT Pub. No.: WO2018/113612
PCT Pub. Date: Jun. 28, 2018

(65) Prior Publication Data

US 2019/0333459 A1 Oct. 31, 2019

(30) Foreign Application Priority Data

Dec. 20, 2016 (CN) ..... 201611188394.3

(51) Int. Cl.
*G09G 3/36* (2006.01)
*G09G 5/06* (2006.01)

(52) U.S. Cl.
CPC ..... *G09G 3/3607* (2013.01); *G09G 3/3611* (2013.01); *G09G 5/06* (2013.01);
(Continued)

(58) Field of Classification Search
CPC ..... G09G 3/3607; G09G 3/3611; G09G 5/06; G09G 2300/0439; G09G 2300/0452;
(Continued)

(56) References Cited

U.S. PATENT DOCUMENTS 8,508,449 B2 8/2013 Broughton et al.
9,183,802 B2 11/2015 Tang et al.
(Continued)

FOREIGN PATENT DOCUMENTS

CN 102257556 A 11/2011
CN 104835468 A 8/2015
(Continued)

OTHER PUBLICATIONS

International Search Report, dated Mar. 22, 2018, for HKC Corporation Limited et al., International Application No. PCT/CN2017/116708, Filed Dec. 16, 2017.
(Continued)

*Primary Examiner* — Amare Mengistu
*Assistant Examiner* — Gloryvid Figueroa-Gibson
(74) *Attorney, Agent, or Firm* — Law Offices of Albert Wai-Kit Chan, PLLC

(57) ABSTRACT

The present disclosure discloses a liquid crystal display device, which includes: a backlight component, including a light guide plate, a light source, a fluorescent film, a reflective sheet, a light compensating layer, and a light absorbing layer; a liquid crystal display panel in which the pixels are divided into a plurality of pixel groups; each pixel group includes an even number of pixels arranged into matrices; a control component including a computing unit and an acquiring unit; the computing unit is configured to receive an image input signal, and compute an average grayscale value of the blue sub-pixels in each pixel group, and obtain two sets of target grayscale value pairs; the acquiring unit is
(Continued)

configured to obtain the corresponding two sets of driving voltage pairs; and, a driving component, configured to drive the blue sub-pixels in the corresponding pixel group.

9 Claims, 7 Drawing Sheets

(52) U.S. Cl.
CPC ..... *G09G 2300/0439* (2013.01); *G09G 2300/0452* (2013.01); *G09G 2320/028* (2013.01); *G09G 2320/0242* (2013.01); *G09G 2320/04* (2013.01)

(58) Field of Classification Search
CPC ..... G09G 2320/0242; G09G 2320/028; G09G 2320/04
USPC ..... 345/690
See application file for complete search history.

(56) References Cited

U.S. PATENT DOCUMENTS

2010/0156774 A1 6/2010 Broughton et al.
2011/0261093 A1 10/2011 Broughton et al.
2012/0113379 A1* 5/2012 Tomizawa ..... G09G 3/3607 349/187
2012/0120130 A1 5/2012 Tang et al.
2013/0181243 A1* 7/2013 Wu ..... H01L 33/505 257/98
2014/0054473 A1* 2/2014 Ren ..... G02B 6/0066 250/504 R
2016/0163277 A1* 6/2016 Ludden ..... G09G 3/3607 345/690
2017/0018238 A1* 1/2017 Kang ..... G09G 3/2074
2017/0098419 A1 4/2017 Kang et al.
2017/0153526 A1* 6/2017 Okabe ..... G02F 1/133514
2018/0075625 A1* 3/2018 Li ..... G09G 3/2003

FOREIGN PATENT DOCUMENTS

CN 106782371 A 5/2017
CN 107340647 A 11/2017

OTHER PUBLICATIONS

Written Opinion, dated Mar. 22, 2018, for HKC Corperation Limited et al., International Application No. PCT/CN2017/116708, Filed Dec. 16, 2017.

* cited by examiner

LIQUID CRYSTAL DISPLAY DEVICE

FIELD

The present disclosure relates to the field of liquid crystal display technology, and more particularly to a liquid crystal display device.

BACKGROUND

Typical large-size liquid crystal display devices mostly make use of negative VA liquid crystal or IPS liquid crystal technology. A VA mode liquid crystal driving the brightness becomes saturated rapidly along with driving voltage at a large viewing angle, which leads to serious viewing angle color shift, and further affects the image quality. Since the brightness of the blue sub-pixels in a side view increases along with the grayscale, the trend of brightness saturation is more significant and faster than that of the red sub-pixels and the green sub-pixels, which makes the image quality presents an obvious defect of leaning towards blue at a mixed-color viewing angle.

SUMMARY

Based on it, it is necessary to provide a liquid crystal display device capable of improving the problem of viewing angle color shift.

A liquid crystal display device, includes a backlight component, which includes a light guide plate, a light source, a fluorescent film, a reflective sheet, a light compensating layer, and a light absorbing layer, the light guide plate includes a light incident surface, a bottom surface, a light emitting surface, and a side surface, the light emitting surface is opposite to the bottom surface, the light incident surface is opposite to the side surface and both are respectively connected between the light emitting surface and the bottom surface; the light source is adjacent to the light incident surface, for configuring to generate a first wavelength light and a second wavelength light; the fluorescent film is located on at the side of the light emitting surface; the reflective sheet includes a first reflective sheet and a second reflective sheet, the first reflective sheet is located at the side of the bottom surface, and the second reflective sheet is located at the side of the side surface, the light compensating layer is located on the first reflective sheet and close to the side surface; the light absorbing layer is located on a side of the second reflective sheet close to the side surface; a liquid crystal display panel, in which the pixels are divided into a plurality of pixel groups; each pixel group includes an even number of pixels arranged into matrices; a control component, which includes a computing unit and an acquiring unit; the computing unit is configured to receive an image input signal, and compute an average grayscale value of the blue sub-pixels in each pixel group according to the image input signal; the computing unit further is configured to obtain two sets of target grayscale value pairs according to the average grayscale value; each set of target grayscale value pairs includes a high grayscale value and a low grayscale value; the front viewing angle brightness of the high grayscale value and the low grayscale value is identical with that of the average grayscale value; the acquiring unit is configured to obtain the corresponding two sets of driving voltage pairs according to the two sets of target grayscale value pairs in each pixel group; and, a driving component, respectively connected with the control component and the liquid crystal display panel; the driving component is configured to drive the blue sub-pixels in the corresponding pixel group according to the two sets of driving voltage pairs.

In one embodiment, the acquiring unit is configured to obtain the two sets of target grayscale value pairs by searching through a grayscale value lookup table; each grayscale value in the grayscale value lookup table corresponds to two sets of target grayscale value pair.

In one embodiment, the control component further includes a determining unit; the determining unit is configured to determine a grayscale range to which the average grayscale value of the blue sub-pixels in each pixel group belongs; the acquiring unit is configured to obtain the corresponding grayscale value lookup table according to the grayscale range of each pixel group, and obtain the corresponding two sets of target grayscale value pairs through utilizing the corresponding grayscale value lookup table according to the average grayscale value of the blue sub-pixels in each pixel group.

In one embodiment, the device further includes a storage component, which is configured to store the grayscale value lookup table.

In one embodiment, when the blue sub-pixels in the corresponding pixel group are driven by the driving component according to the two sets of driving voltage pairs, one of the driving voltages of two adjacent blue sub-pixels is controlled to be high and the other one of the driving voltages is controlled to be low.

In one embodiment, the material of the light absorbing layer is a red light absorbing material, or a red light and blue light absorbing material.

In one embodiment, the material of the light absorbing layer includes one or more selected from a group consisting of phthalocyanine pigment, anthocyanin pigment, and diimine pigment.

In one embodiment, the light compensating layer is dotted distributed, and the volume and density of the light compensating layer are decreased along a direction from the side surface of the light guide plate towards the light incident surface.

In one embodiment, the material of the light compensating layer is a green quantum dot material or green fluorescent powder.

In one embodiment, the light source is an LED light source, and the LED light source includes a blue light chip and red fluorescent powder.

In one embodiment, the red fluorescent powder includes one or more selected from a group consisting of nitride fluorescent powder, fluoride fluorescent powder, and sulfide fluorescent powder.

In one embodiment, the material of the fluorescent film is green fluorescent powder or a green quantum dot material.

DETAILED DESCRIPTION OF THE EMBODIMENTS

In order to make the aims, technical solutions and advantages of the present disclosure more clear, the present disclosure will be further described in detail below with reference to the drawings and embodiments. It is to be understood that, the specific embodiments described herein portrays merely some illustrative embodiments of the present disclosure, and are not intended to limit the patentable scope of the present disclosure.

Figure 1:
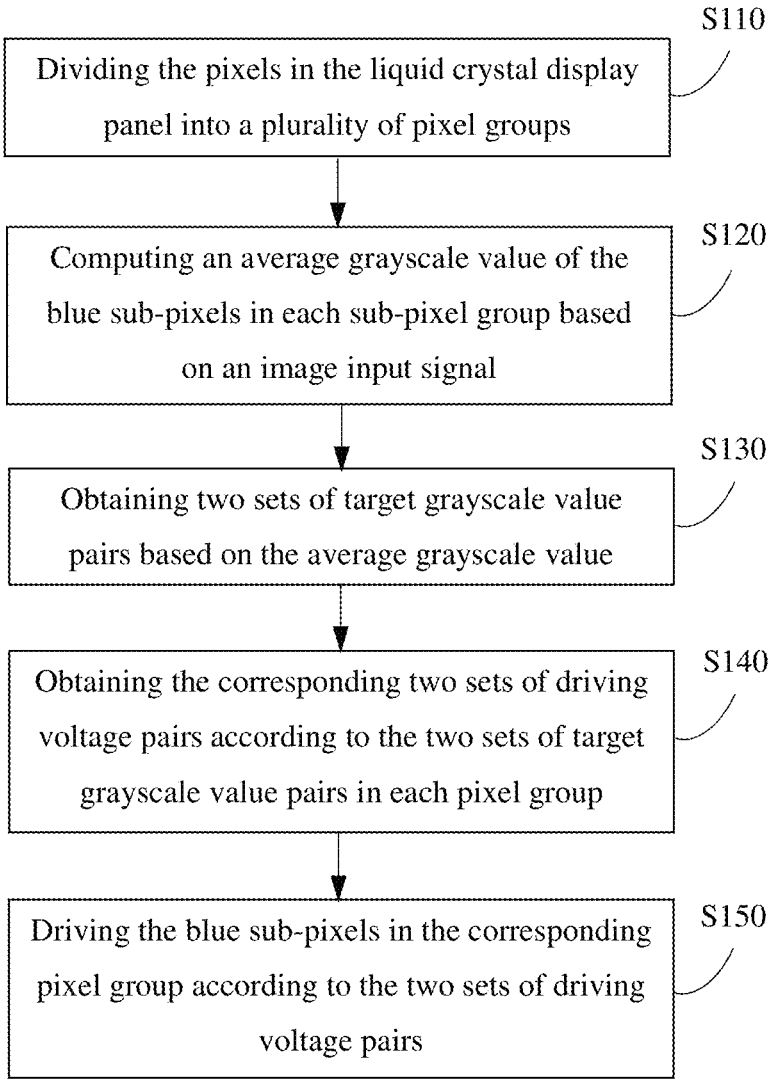
FIG. 1 is a flowchart illustrating an embodiment of a driving method of a liquid crystal display panel according to the present disclosure.

FIG. 1 is a flowchart illustrating an embodiment of a driving method of a liquid crystal display panel. The driving method of the liquid crystal display panel can improve the defect of color shift (or chromatic aberration) caused by the mismatch of refractive index of the liquid crystal at a large viewing angle. In particular, it is capable of effectively improving the defect of color shift caused by premature saturation of the blue sub-pixels at the large viewing angle. The liquid crystal display panel may be a TN, OCB, VA mode liquid crystal display panel or a curved liquid crystal display panel, but is not limited thereto.

Referring to FIG. 1, the driving method includes the following steps:

S110, dividing the pixels in the liquid crystal display panel into a plurality of pixel groups.

Figure 2:
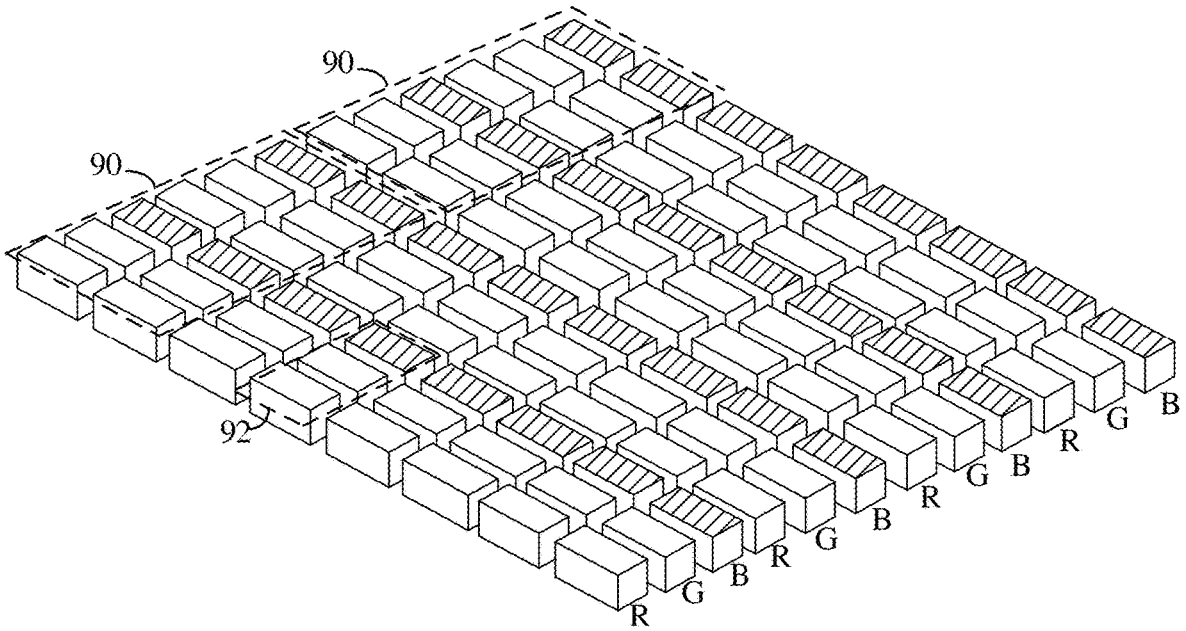
FIG. 2 is a schematic diagram illustrating pixel division after executing S110 in FIG. 1.

After dividing, each pixel group includes an even number of pixels arranged into matrices. In this embodiment, each pixel group 90 includes four pixels arranged into matrices after dividing, as shown in FIG. 2. Each of the pixels 92 includes a red sub-pixel R, a green sub-pixel G, and a blue sub-pixel B, that is, each pixel group 90 includes four blue sub-pixels arranged into matrices. In another embodiment, the number of pixels included in each pixel group could be set as needed.

S120, obtaining an average grayscale value of the blue sub-pixels of each sub-pixel group based on an image input signal.

The grayscale value of each blue sub-pixel is represented by $B_{i,j}$. Wherein B represents blue, and (i, j) represents the sequential number of the blue sub-pixel in the entire liquid crystal display panel. The average grayscale value B'n of the blue sub-pixels in each sub-pixel group is calculated as follows:

$$B'n=\text{Average}(B_{i,j}+B_{i+1,j}+B_{i,j+1}+B_{i+1,j+1}).$$

S130, obtaining two sets of target grayscale value pairs based on the average grayscale value of each pixel group.

Each set of target grayscale value pairs includes a high grayscale value and a low grayscale value. The high grayscale value and the low grayscale value need to satisfy that the front viewing angle brightness after mixing the high grayscale value and the low grayscale value is identical with that of the average grayscale value B'n. Optionally, the brightness at the large viewing angle corresponding to the high grayscale value and the low grayscale value is as close as possible to the brightness of the average grayscale value at the front viewing angle. In one embodiment, the difference between the high grayscale value and the low grayscale value in the target grayscale value pairs needs to be greater than a preset difference range, thereby ensuring two grayscale values in the target grayscale value pairs have a relatively large grayscale difference. The two sets of target grayscale value pairs have different improving ranges on viewing angle color shift, the improving range of one set on viewing angle color shift is lower than that of the other one, that is, one set is able to have a better effect on improving color shift for the high greyscale value at the large viewing angle, while the other set is able to have a better effect on improving color shift for the low greyscale value at the large viewing angle. In this embodiment, the high grayscale value is relative to the low grayscale value of the other set. The large viewing angle could be defined as greater than 60° or customized according to a user. The acquisition of the target grayscale value pairs can be performed by searching through a grayscale value lookup table (LUT). Specifically, each grayscale value in the grayscale value lookup table corresponds to two sets of target grayscale value pairs. The grayscale value lookup table in one embodiment is shown as following:

| Input grayscale | The 1st set of target grayscale value pairs | | The 2nd set of target grayscale value pairs | |
|---|---|---|---|---|
| value | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

The above grayscale value lookup table is merely an example and does not constitute a limitation on a specific grayscale value lookup table. The color shift improvement ranges of the two sets of target grayscale value pairs in each grayscale value lookup table do not overlap as much as possible, thereby ensuring from the low grayscale value to the high grayscale value, the brightness change of the blue sub-pixels along with the greyscale value can be close to the effect from the front viewing angle, effectively improving the defect of color shift caused by premature saturation of the blue sub-pixels at the large viewing angle. The grayscale value lookup table can be pre-stored in a storage component. Therefore, the corresponding two sets of target grayscale value pairs can be obtained according to the average grayscale value.

Figure 3:
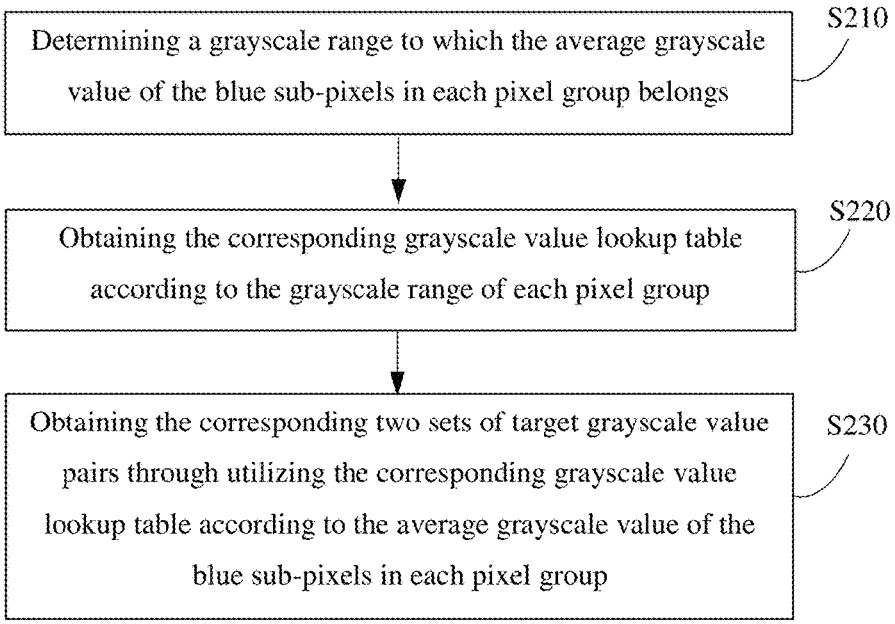
FIG. 3 is a detailed flowchart illustrating S130 in FIG. 1.

In one embodiment, the acquisition process of the target grayscale value pairs includes the following steps, as shown in FIG. 3.

S210, determining a grayscale range to which the average grayscale value of the blue sub-pixels in each pixel group belongs.

Before determining the grayscale range to which the average grayscale value belongs, the grayscale value of the blue sub-pixels is divided into a preset number of grayscale ranges, such as 0-50, 51-101, 102-152, 153-203, and 204 to 255. It can be understood that the grayscale ranges could be divided according to actual needs, and are not limited thereto. Each grayscale range could be determined by the desired degree to which the color shift is improved. Different grayscale range divisions are also pre-stored in the storage component so that they could be directly searched to be obtained.

S220, obtaining the corresponding grayscale value lookup table according to the grayscale range of each pixel group.

Different grayscale ranges have different effects on the viewing angle color shift, thus different grayscale ranges correspond to different grayscale value lookup tables, so that correspond to different grayscale values and could obtain the target grayscale value pairs more suitable to the grayscale ranges, the target grayscale value pairs corresponds to the driving voltages, that is, through more suitable driving voltages to perform driving, thus ensuring the brightness of the blue sub-pixels after adjusting at the side viewing angle changing along with greyscale is closer to the changing curve at the front viewing angle. The correspondence table between the grayscale value ranges and the grayscale value lookup tables may be pre-stored in the storage component in advance, therefore the corresponding driving voltage can be determined according to the obtained grayscale range.

For example, when the average grayscale value belongs to 0~50, the grayscale value lookup table LUT1 is used, as shown in the following table:

| Input grayscale | The 1st set of target grayscale value pairs | | The 2nd set of target grayscale value pairs | |
|---|---|---|---|---|
| value | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

When the average grayscale value belongs to 51~100, the grayscale value lookup table LUT2 is used, as shown in the following table:

| Input average | The 3rd set of target grayscale value pairs | | The 4th set of target grayscale value pairs | |
|---|---|---|---|---|
| value | BH1 | BL1 | BH2 | BL2 |
| 0 | 0 | 0 | 0 | 0 |
| 1 | 40 | 0 | 33 | 0 |
| 2 | 75 | 0 | 78 | 10 |
| 3 | 130 | 5 | 90 | 35 |
| 4 | 180 | 15 | 120 | 45 |
| 5 | 200 | 35 | 160 | 65 |
| . | . | . | . | . |
| . | . | . | . | . |
| . | . | . | . | . |
| 255 | 255 | 160 | 255 | 160 |

Also, the above is merely a specific example, and the range division of the grayscale value lookup tables and the respective grayscale value lookup tables are not limited to the implementations defined in the above embodiment.

S230, obtaining the corresponding two sets of target grayscale value pairs through utilizing the corresponding grayscale value lookup table according to the average grayscale value of the blue sub-pixels in each pixel group.

As shown above, according to the obtained average grayscale value and the grayscale value lookup table, the corresponding two sets of target grayscale value pairs can be obtained by looking up the table.

S140, obtaining the corresponding two sets of driving voltage pairs according to the two sets of target grayscale value pairs in each pixel group.

There is a one-to-one correspondence between the driving voltage and the grayscale value, thus the corresponding driving voltage can be obtained according to the grayscale value. Therefore, the corresponding two sets of driving voltages ($B_{n'_H1}$ and $B_{n'_L1}$, $B_{n'_H2}$ and $B_{n'_L2}$) can be determined based on the two sets of target grayscale value pairs. In this embodiment, since there is a one-to-one correspondence between the driving voltage and the grayscale value, there are also a high driving voltage and a low driving voltage in the driving voltage pair. The driving voltage pair can be obtained by searching through the driving voltage lookup table. The driving voltage lookup table is a correspondence table between the color grayscale values in the input signals of the blue sub-pixels and the driving voltages. Specifically, each grayscale value of the blue sub-pixel corresponds to one driving voltage signal.

Figure 4:
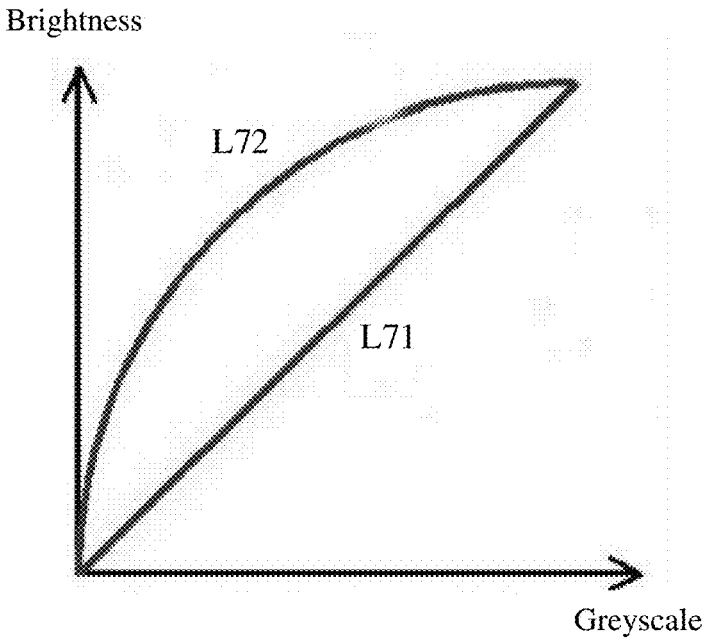
FIG. 4 is a comparison diagram illustrating the curves of brightness changing along with grayscale of the blue sub-pixels at a front viewing angle and at a side viewing angle when driven by a single driving voltage.
Figure 5:
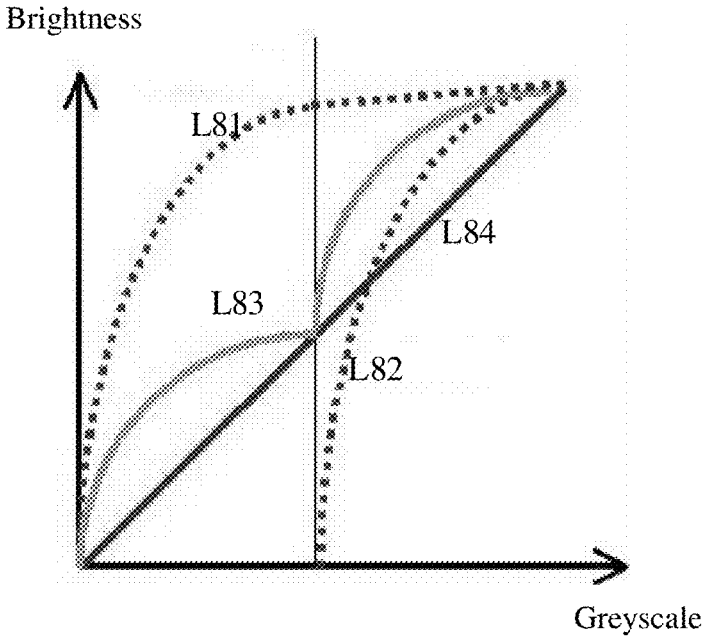
FIG. 5 a diagram illustrating the curves of brightness changing along with grayscale of the blue sub-pixels at a side viewing angle when driven by a high driving voltage, a low driving voltage, and an alternating high and low driving voltage.

Each set of the high and low driving voltage pairs enables the curve of the brightness of the adjusted blue sub-pixels changing along with greyscale at the side view to be closer to the curve of the brightness at the front view changing along with greyscale. By driving the blue sub-pixels in each sub-pixel group by the high and low voltages, the brightness variation of the blue sub-pixels at the side view can be controlled, so that the saturation trend of the blue sub-pixels is close to the red sub-pixels and the green sub-pixels or close to the brightness saturation curve trend of the red sub-pixels, the green sub-pixels and the blue sub-pixels at the front view, so as to reduce the defect of the viewing angle color shift. FIG. 4 is a diagram illustrating the curves of the brightness changing along with grayscale values of the blue sub-pixels at the front viewing angle and the side viewing angle when driven by a single driving voltage, in which L71 represents the curve at the front view and L72 represents the curve at the side view. Obviously, at the side view, the curve of the brightness changing along with the grayscale values would easily approach saturation, so that the image quality has an obvious defect of leaning towards blue at the mixed-color viewing angle. FIG. 5 is a comparison diagram illustrating the curves of the changing brightness at the side viewing angle when driven by the alternating high and low driving voltage pair, the high driving voltage, and the low driving voltage. Among them, L81 is the curve of brightness changing along with greyscale seen from the side viewing angle when driven by the high voltage, L82 is the curve of brightness changing along with greyscale seen from the side viewing angle when driven by the low voltage, and L83 is a mixture of L81 and L82, that is, the curve of brightness changing along with greyscale seen from the side viewing angle when driven by the alternating high and low voltage pair, and obviously it is closer to the curve L84 of the brightness changing along with greyscale at the front view, that is, using the alternating high and low driving voltage pair could improve the viewing angle color shift.

Since different driving voltages have different effects to different grayscale value ranges on improving the viewing angle color shift, so that one set of the two sets of driving voltage pairs necessarily corresponds to the high grayscale value, while the other one corresponds to the low greyscale value. Therefore, in each pixel group there is one driving voltage pair capable of improving color shift for the high greyscale value at the large viewing angle and one driving voltage pair capable of improving color shift for the low greyscale value at the large viewing angle, so that from the low greyscale value to the high greyscale value, the brightness changing along with greyscale values of the blue sub-pixels could be close to the effect at the front viewing angle, effectively improving the defect of the color shift caused by the premature saturation of the blue sub-pixels at the large viewing angle.

S150, driving the blue sub-pixels in the corresponding pixel group according to the two sets of driving voltage pairs.

Figure 6:
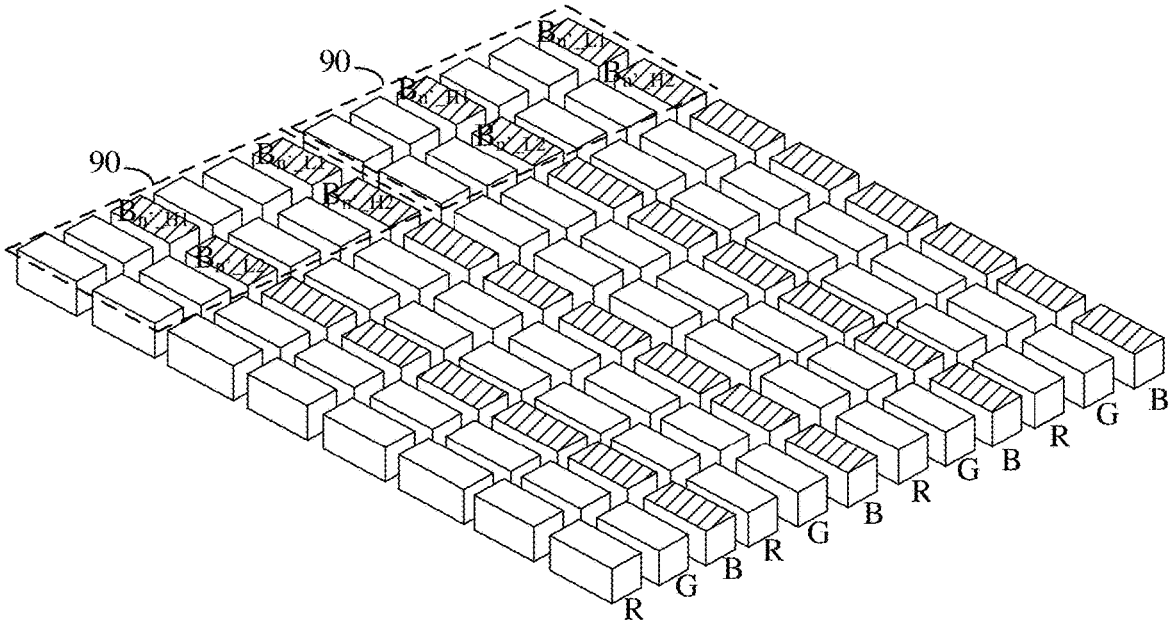
FIG. 6 is a schematic diagram illustrating driving after executing S150.

Specifically, during the driving process, the blue sub-pixels in the corresponding pixel group are respectively driven by the two sets of driving voltage pairs ($B_{n'_H1}$ and $B_{n'_L1}$, $B_{n'_H2}$ and $B_{n'_L2}$), so that one of the driving voltages of the adjacent two blue sub-pixels is high and the other one is low, thereby improving the viewing angle color shift defect by alternating high and low voltage driving, as shown in FIG. 6.

In the above driving method of the liquid crystal display panel, two sets of target grayscale value pairs are obtained according to the average grayscale value of each pixel group on the liquid crystal display panel. Each set of target grayscale value pairs includes a high grayscale value and a low grayscale value; the front viewing angle brightness of the mixed two is identical with that of the average grayscale value, so that the brightness would not be affected. The corresponding two sets of driving voltage pairs are obtained according to the two sets of target grayscale value pairs, so that there are two sets of driving voltage pairs which could improve the viewing angle color shift in each pixel group. Since different driving voltages have different effects to different grayscale value ranges on improving the viewing angle color shift, so that after mixing, from the low greyscale value to the high greyscale value, the brightness of the blue sub-pixels changing along with greyscale values could be close to the effect at the front viewing angle, effectively improving the defect of the color shift caused by the premature saturation of the blue sub-pixels at the large viewing angle. Moreover, after making use of the above driving method, the pixels on the liquid crystal display panel need not be designed as primary pixels and secondary pixels, thereby greatly improving the transmittance and resolution of TFT display panels, and reducing the backlight design cost.

Figure 7:
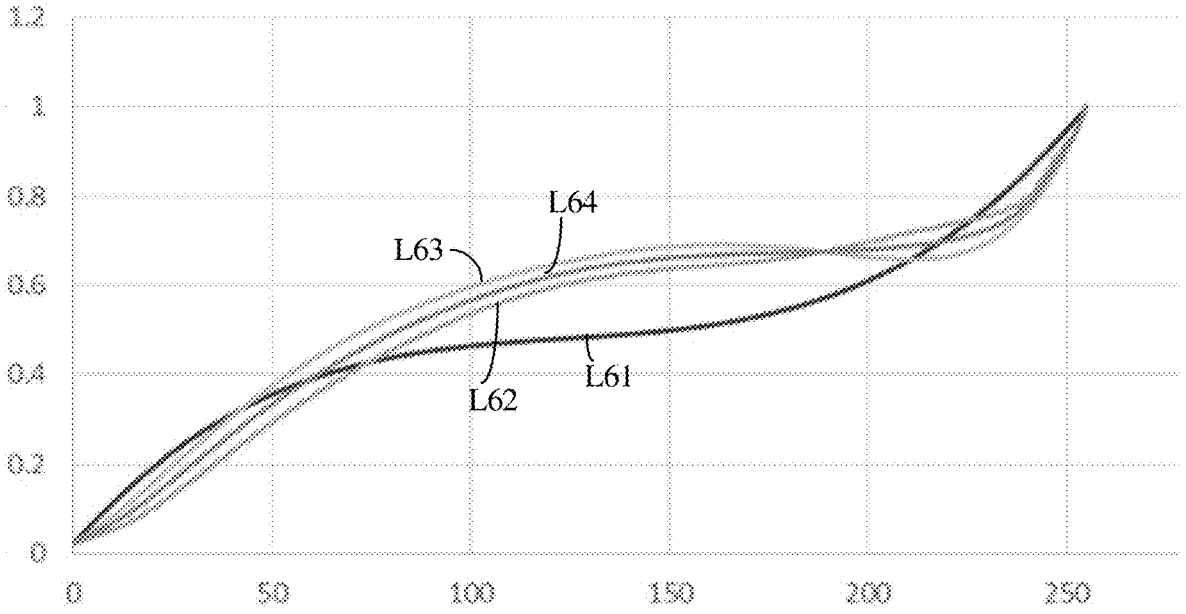
FIG. 7 is a comparison diagram illustrating the curves of ideal brightness changing along with grayscale and each of brightness changing along with grayscale under two voltage combinations.
Figure 8:
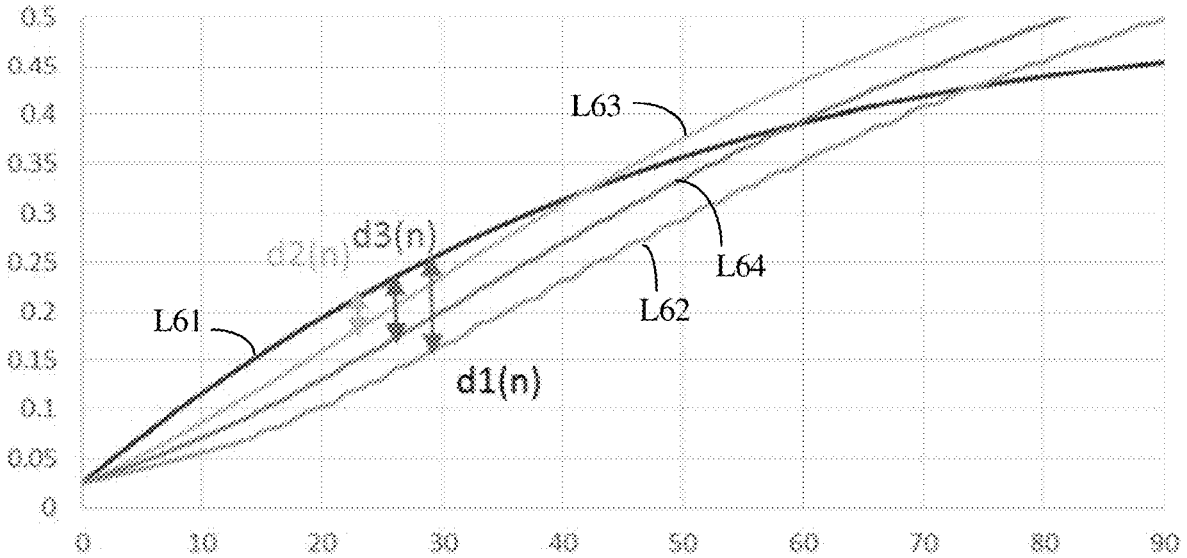
FIG. 8 and FIG. 9 are partial enlarged views of FIG. 7.
Figure 9:
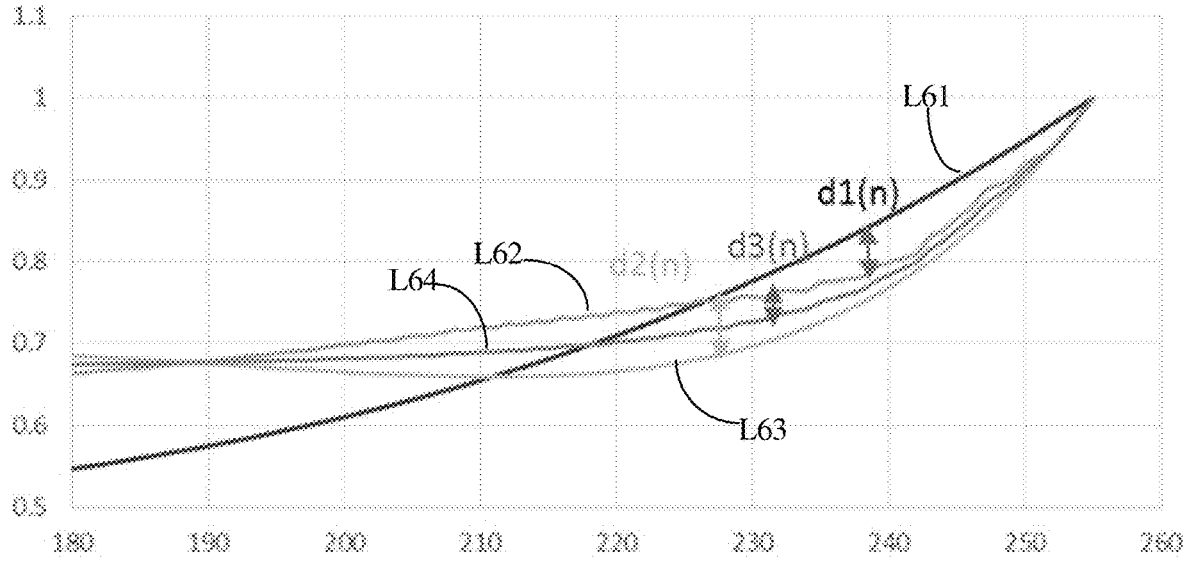

The color shift improving effect of the driving method in this embodiment is further described below with reference to FIGS. 7~9. Referring to FIG. 7, Target gamma is a curve of the brightness of the target blue sub-pixels changing along with grayscale values, corresponding to L61 in FIG. 7. Through the blue sub-pixel spatial division must satisfy that the RGB brightness ratio does not change at the front view. There are various combinations of high voltage and low voltage signals that are spatially divided by the blue sub-pixels, and the saturation situations of the side-view brightness changing along with the voltages caused by each combination are different. As shown in FIG. 7, the saturation situations of the side-view brightness changing along with the voltages caused by the high voltage combination gamma 1 and the low voltage combination gamma 2 spatially divided by the blue sub-pixels are different, which respectively correspond to L62 and L63 in FIG. 7, FIG. 8, and FIG. 9 are partial enlarged views of FIG. 7. As seen from FIGS. 7~9, the blue sub-pixels on the display panel are driven by one set of high and low voltages, and the saturation trend of the curve of the brightness changing along with the voltages is much faster than that of the Target gamma. That is, the high voltage and low voltage combination by only one blue sub-pixel spacial division cannot meet the requirements of the brightness of high and low voltages being close to the target brightness.

As shown in FIG. 8, when considering the changing relationship between the low voltage (corresponding to the low grayscale value) and the brightness, the difference d1($n$) between the actual brightness of gamma 1 and the target brightness is much greater than the difference d2($n$) between the actual brightness of gamma 2 and the target brightness. However, as shown in FIG. 9, when considering the changing relationship between the high voltage and the brightness, the difference d1($n$) between the actual brightness of gamma 1 and the target brightness is much smaller than the difference d2($n$) between the actual brightness of gamma 2 and the target brightness. That is, gamma 1 is suitable when the relatively high voltage signal of blue sub-pixels is present on the image (that is, the grayscale value of blue sub-pixels is relatively high). Otherwise, gamma 2 is suitable when the relatively low voltage signal of blue sub-pixels is present on the image (that is, the grayscale value of blue sub-pixels is relatively low). In the driving method of this embodiment, each pixel group includes one driving voltage pair suitable for the high grayscale value and one driving voltage pair suitable for the low grayscale value, which makes the viewing angle brightness changing curve generated by the two sets of driving voltages combination combines the advantages of both, so that the viewing angle curve is closer to the requirements of the target value, and the curve changes smoothly, without abrupt change of color or abnormal color mixing. Gamma 3 (corresponding to L64 in FIGS. 7~9) in FIGS. 7~9 is a viewing angle brightness curve generated by using a combination of high and low voltages such as gamma 1 plus gamma 2. Obviously, the difference d3($n$) between the actual brightness of gamma 3 and the target brightness is always between d1($n$) and d2($n$), that is, the change is closer to the requirements of target value, so that the viewing angle color shift problem could be effectively improved.

Figure 10:
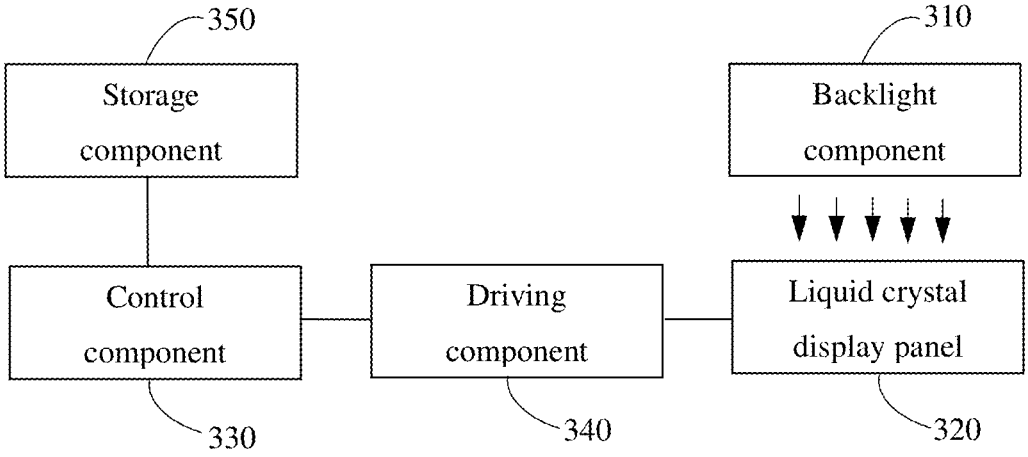
FIG. 10 is a block diagram illustrating an embodiment of the structure of a liquid crystal display device.

The present disclosure also provides a liquid crystal display device as shown in FIG. 10. The liquid crystal display device could perform the above driving method. The liquid crystal display device includes a backlight component 310, a liquid crystal display panel 320, a control component 330, and a driving component 340. The control component 330 and the driving component 340 could be integrated on the liquid crystal display panel 310, and the backlight component 310 could be directly implemented by using a backlight module. It could be understood that the manner in which the various components are integrated is not limited thereto.

The backlight component 310 is configured to provide backlight. The backlight component 310 could be straight down type backlight or side light type backlight. In this embodiment, a side light backlight component is taken as an example. The backlight component 310 includes a light source 311, a light guide plate 312, a fluorescent film 313, a reflection sheet, a light compensating layer 315, and a light absorbing layer 316.

Figure 12:
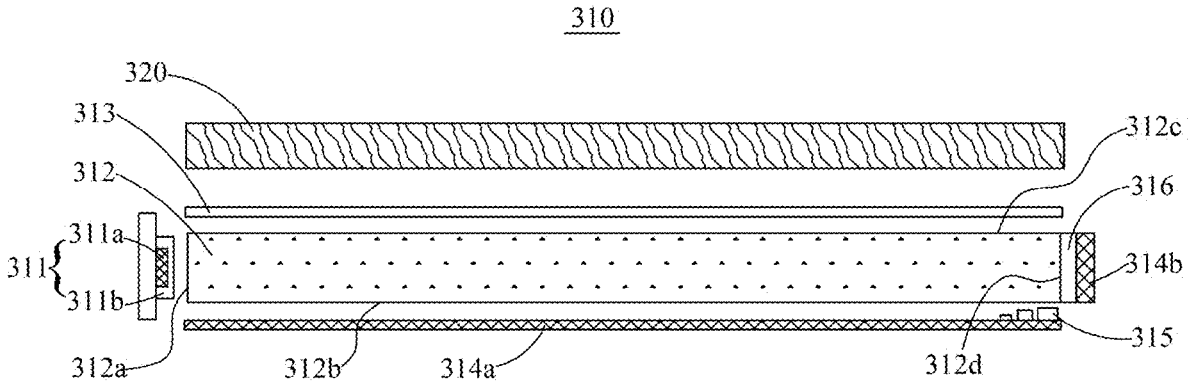
FIG. 12 is a block diagram illustrating an embodiment of the structure of a backlight component.

Referring to FIG. 12, specifically, the light source 311 may be white light, RGB three-color light source, RGBW four-color light source, or RGBY four-color light source, but is not limited thereto. In this embodiment, the light source 311 is configured to generate a first wavelength light and a second wavelength light, the first wavelength light excites the fluorescent film 313 to generate a first excitation light of a specified color; optionally, the light source 311 is an LED source which includes a blue light chip 311*a* and red fluorescent powder 311*b*, the blue light chip 311*a* emits blue light, and the red fluorescent powder 311*b* is encapsulated around the blue light chip 311*a*, and is excited by blue light emitted by the blue light chip 311*a* to generate red light, and the red fluorescent powder 311*b* may be nitrogen fluorescent powder, fluoride fluorescent powder or sulfide fluorescent powder, etc., therefore, the light source 311 is shown as a magenta light (mixed light of blue light and red light);

The light guide plate 312 includes a light incident surface 312*a*, a bottom surface 312*b*, a light emitting surface 312*c*, and a side surface 312*d*, the light emitting surface 312*c* is opposite to the bottom surface 312*b*, the light incident surface 312*a* is opposite to the side surface 312*d* and both are respectively connected between the light emitting surface 312*c* and the bottom surface 312*b*, the light source 311 is adjacent to the light incident surface 312*a*; the reflective sheet includes a first reflective sheet 314*a* and a second reflective sheet 314*b*, the first reflective sheet 314*a* and the second reflective sheet 314*b* are respectively located at the sides of the bottom surface 312*b* and the side surface 312*d* of the light guide plate 312;

The fluorescent film 313 is located at the side of the light emitting surface 312*c*, the material of the fluorescent film 313 includes, for example, green fluorescent powder or a green quantum dot material, the light emitted from the light guide plate 312 includes blue light and red light, after going through the fluorescent film 313, a portion of the blue light directly passes through, a larger portion excites the fluorescent film 313 to generate green light, and the red light completely passes through the fluorescent film 313, and the red light, blue light and green light are mixed to generate white color on the liquid crystal display panel;

The light compensating layer 315 is located on the first reflective sheet 314*a* and close to the side surface 312*d*, the light compensating layer 315 is dotted distributed for example, since along a direction from the side surface 312*d* of the light guide plate 312 towards the light incident surface 312*a*, the degree of color shift of the liquid crystal display panel 30 becomes less and less, in order to achieve different light compensation effects to different degrees of color shift, the volume and density of each dot on the light compensating layer 315 in this direction are decreased. In addition, the material of the light compensating layer 315 includes, for example, green fluorescent powder or a green quantum dot material, which can absorb blue light, and excited to generate green light, so as to perform green light compensation for the edge of the liquid crystal display panel 320.

The light absorbing layer is located on a side of the second reflective sheet close to the side surface, of which the material is, for example, a red light absorbing material, or a red light and blue light absorbing material. The light absorbing layer 316 material has a characteristic of having relatively high absorption to a red light band, or red and blue light bands, and have relatively high transmittance for other color light bands, so that when red light, or red light and blue light are irradiated on the light absorbing layer 316, the light of the red light band or the red light and blue light bands is absorbed, while the light in other bands is transmitted unaffected. Optionally, the material of the light absorbing layer 316 includes, for example, one or more selected from a group consisting of phthalocyanine pigment, anthocyanin pigment, and diimine pigment;

In the backlight component 310, the light absorbing layer 316 and the light compensating layer 315 are set at the side of the light emitting surface 312*c*, the light absorbing layer 316 is configured to absorb incident light that is emit to the first reflection sheet 314*a* or the second reflection sheet 314*b*, so as to solve the problem of color shift caused by the diffuse reflection light directly emitting from the light guide plate 312 after the incident light passing through the reflective sheet, at the meantime, the light compensating layer 315 is excited to generate the second excitation light having the same color as the first excitation light, thereby solving the problem of color shift due to lack of the specified color excitation light at the edge of the screen, the light compensating layer 315 and the light absorbing layer 316 are combined to work together to absorb the specific color spectrum while also compensate for the excitation light of the specified color, so as to solve the problem of color shift around the display screen in the prior art.

The liquid crystal display panel 320 could be a TN, OCB, or VA type TFT display panel, but is not limited thereto. The liquid crystal display panel 320 may be a liquid crystal display panel with a curved panel. In this embodiment, the pixels in the liquid crystal display panel 320 are divided into a plurality of pixel groups. Each pixel group includes an even number of pixels arranged into matrices. In this embodiment, each pixel group includes four pixels arranged into matrices, that is, it includes four blue sub-pixels arranged into matrices, as shown in FIG. 2.

Figure 11:
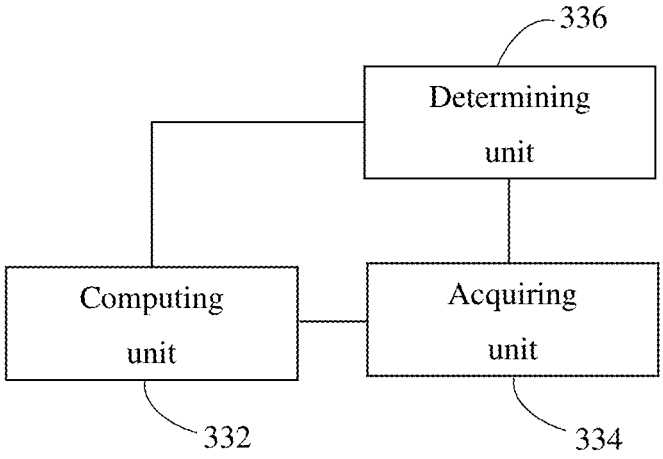
FIG. 11 is a block diagram illustrating an embodiment of the structure of a control component.

The control component 330 includes a computing unit 332 and an acquiring unit 334, as shown in FIG. 11. The computing unit 332 is configured to receive an image input signal, and compute an average grayscale value of the blue sub-pixels in each pixel group according to the image input signal. The computing unit 332 is further configured to obtain two sets of target grayscale value pairs according to the average grayscale value. Each set of target grayscale value pairs includes a high grayscale value and a low grayscale value. The front viewing angle brightness of the high and low grayscale value is the same as the front viewing angle brightness of the corresponding average grayscale value. The target grayscale value pairs could be obtained based on a grayscale value lookup table. Each grayscale value in the grayscale value lookup table corresponds to two sets of target grayscale value pairs. Therefore, according to the obtained average grayscale value, the corresponding two sets of target grayscale value pairs could be obtained by searching through the grayscale value lookup table. In one embodiment, a storage component 350 is also included. The storage component 350 is configured to store the grayscale value lookup table.

In one embodiment, the control component 330 further includes a determining unit 336. The determining unit 336 is configured to determine a grayscale range to which the average grayscale value of each pixel group belongs. An acquiring unit 334 is further configured to obtain a corresponding grayscale value lookup table according to the grayscale range, and obtain two sets of target grayscale value pairs by utilizing the corresponding grayscale value lookup table according to the two sets of target grayscale value pairs of each sub-pixel group. In this embodiment, the storage component 350 would store each grayscale range, the correspondence relationship between each grayscale range and the grayscale value lookup table, and the grayscale value lookup table corresponding to each grayscale range in advance. The acquiring unit 334 is further configured to obtain the corresponding two sets of driving voltage pairs according to the two sets of target grayscale value pairs in each pixel group.

The driving component 340 is respectively connected to the control component 330 and the liquid crystal display panel 320. The driving component 340 is configured to drive the blue sub-pixels in the corresponding pixel group according to the two sets of driving voltage pairs. Specifically, when performing driving, the driving component 340 controls one of the driving voltages of the adjacent two blue sub-pixels to be high, the other one to be low, so that each pixel group is driven by the alternating high and low voltages.

In the above liquid crystal display device, two sets of target grayscale value pairs are obtained according to the average grayscale value of each pixel group on the liquid crystal display panel. Each set of target grayscale value pairs includes the high grayscale value and the low grayscale value, and the front viewing angle brightness of the mixed two is the same as the front viewing angle brightness of the average grayscale value, so that the brightness is not affected. The corresponding two sets of driving voltage pairs are obtained according to the target grayscale value pairs, so that each pixel group has two sets of driving voltage pairs that improve the viewing angle color shift. Since different driving voltage pairs have different effects to different grayscale value ranges on improving the viewing angle color shift, so that after mixing from the low greyscale value to the high greyscale value, the change of the brightness of the blue sub-pixels along with the greyscale values could be close to the effect of the front viewing angle, effectively improving the defect of color shift caused by premature saturation of the blue sub-pixels at the large viewing angle.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this description.

The foregoing description portrays merely some illustrative embodiments of the present disclosure, and the description thereof is relatively specific and detailed, and are not intended to limit the patentable scope of the present disclosure. It should be noted that any variation and improvement may be made by those skilled in the art without departing from the conception of the present disclosure, shall all fall within the protection scope of the present disclosure. Therefore, the protection scope of the present disclosure should be determined by the appended claims.

What is claimed is:

1. A liquid crystal display device, comprising:

a backlight component, comprising a light guide plate, a light source, a fluorescent film, a reflective sheet, a light compensating layer, and a light absorbing layer, the light guide plate comprising a light incident surface, a bottom surface, a light emitting surface, and a side surface, the light emitting surface being opposite to the bottom surface, the light incident surface being opposite to the side surface and both being respectively connected between the light emitting surface and the bottom surface; the light source being adjacent to the light incident surface, configured to generate a first wavelength light and a second wavelength light; the fluorescent film being located at a side of the light emitting surface; the reflective sheet comprising a first reflective sheet and a second reflective sheet, the first reflective sheet being located at a side of the bottom surface, the second reflective sheet being located at a side of the side surface, the light compensating layer being located on the first reflective sheet and close to the side surface;

the light absorbing layer being located on a side of the second reflective sheet close to the side surface;

a liquid crystal display panel, in which pixels are divided into a plurality of pixel groups; each pixel group comprising an even number of pixels arranged into matrices;

wherein the liquid crystal display device comprises one or more processors and a non-transitory program storage medium storing a program code executable by the one or more processors, the program code, when executed by the one or more processors, implements the following operations:

receiving an image input signal, and computing an average grayscale value of blue sub-pixels in each pixel group according to the image input signal; obtaining two sets of target grayscale value pairs according to the average grayscale value; and obtaining the corresponding two sets of driving voltage pairs according to the two sets of target grayscale value pairs in each pixel group; and driving the blue sub-pixels in the corresponding pixel group according to the two sets of driving voltage pairs;

obtaining the two sets of target grayscale value pairs by searching through a grayscale value lookup table; each grayscale value in the grayscale value lookup table corresponds to two sets of target grayscale value pair;

determining a grayscale range to which the average grayscale value of the blue sub-pixels in each pixel group belongs; obtaining a corresponding grayscale value lookup table according to the grayscale range of each pixel group, and obtaining the corresponding two sets of target grayscale value pairs through utilizing the corresponding grayscale value lookup table according to the average grayscale value of the blue sub-pixels in each pixel group;

when the blue sub-pixels in the corresponding pixel group are driven by the driving component according to the two sets of driving voltage pairs, controlling one of the driving voltages of two adjacent blue sub-pixels to be high and controlling the other one of the driving voltages to be low.

2. The liquid crystal display device of claim 1, wherein, the light compensating layer is dotted distributed, and a volume and a density of the light compensating layer are decreased along a direction from the side surface of the light guide plate towards the light incident surface.

3. The liquid crystal display device of claim 2, wherein, the light compensating layer is made of a green quantum dot material or green fluorescent powder.

4. The liquid crystal display device of claim 1, the program code, when executed by the one or more processors, further implements the following operations:

storing the grayscale value lookup table.

5. The liquid crystal display device of claim 1, wherein, the light absorbing layer is made of one or more selected from a group consisting of phthalocyanine pigment, anthocyanin pigment, and diimine pigment.

6. The liquid crystal display device of claim 1, wherein, the light source is a LED light source, and the LED light source comprises a blue light chip and red fluorescent powder.

7. The liquid crystal display device of claim 6, wherein, the red fluorescent powder comprises one or more selected from a group consisting of nitride fluorescent powder, fluoride fluorescent powder, and sulfide fluorescent powder.

8. The liquid crystal display device of claim 1, wherein, the light absorbing layer is made of a red light absorbing material, or a red light and blue light absorbing material.

9. The liquid crystal display device of claim 1, wherein, the fluorescent film is made of a green fluorescent powder or a green quantum dot material.

* * * * *